US010941455B2

(12) United States Patent
Dean

(10) Patent No.: US 10,941,455 B2
(45) Date of Patent: Mar. 9, 2021

(54) SANDWICH STRUCTURE AND ASSOCIATED PRESSURE-BASED FORMING METHOD

(71) Applicant: The Boeing Company, Chicago, IL (US)

(72) Inventor: Thomas A. Dean, Maple Valley, WA (US)

(73) Assignee: The Boeing Company, Chicago, IL (US)

( * ) Notice: Subject to any disclaimer, the term of this patent is extended or adjusted under 35 U.S.C. 154(b) by 420 days.

(21) Appl. No.: 15/164,495

(22) Filed: May 25, 2016

(65) Prior Publication Data

US 2017/0342516 A1 Nov. 30, 2017

(51) Int. Cl.

| | |
|---|---|
| ***C21D 1/26*** | (2006.01) |
| ***C21D 9/00*** | (2006.01) |
| *C22F 1/04* | (2006.01) |
| *C22F 1/10* | (2006.01) |
| *C22F 1/18* | (2006.01) |

(52) U.S. Cl.

CPC ..... *C21D 1/26* (2013.01); *C21D 9/0068* (2013.01); *C22F 1/04* (2013.01); *C22F 1/10* (2013.01); *C22F 1/183* (2013.01)

(58) Field of Classification Search

CPC ..... C21D 1/26; C21D 9/0068

See application file for complete search history.

(56) References Cited

U.S. PATENT DOCUMENTS

| | | | | |
|---|---|---|---|---|
| 3,633,267 | A * | 1/1972 | Deminet | B21D 47/00 228/181 |
| 3,927,817 | A * | 12/1975 | Hamilton | B21D 26/055 228/157 |
| 4,217,397 | A * | 8/1980 | Hayase | B23K 11/0093 228/157 |
| 4,292,375 | A * | 9/1981 | Ko | B21D 26/055 428/593 |
| 4,304,350 | A * | 12/1981 | Paez | B23K 20/02 228/118 |
| 5,118,026 | A * | 6/1992 | Stacher | B23K 20/18 228/157 |
| 5,143,276 | A * | 9/1992 | Mansbridge | B21D 26/055 228/157 |
| 5,723,225 | A | 3/1998 | Yasui et al. | |
| 6,656,603 | B2 | 12/2003 | Buldhaupt et al. | |
| 6,820,796 | B2 | 11/2004 | Sanders | |
| 7,146,727 | B2 | 12/2006 | Kistner et al. | |
| 8,707,747 | B1 * | 4/2014 | Norris | B21D 22/205 228/157 |

(Continued)

OTHER PUBLICATIONS

Callister et al. "Fundamentals of Materials Science and Engineering, 4th edition" 2012. ISBN 978-1-118-06160-2. p. 280 (Year: 2012).*

(Continued)

*Primary Examiner* — Nicholas A Wang

(74) *Attorney, Agent, or Firm* — Walters & Wasylyna LLC

(57) ABSTRACT

A sandwich structure forming method including the steps of (1) providing a sandwich structure comprising a core positioned between a first liner sheet and a second liner sheet; (2) positioning the sandwich structure into a cavity of a die assembly; and (3) pressurizing the core to expand the sandwich structure into engagement with the die assembly.

20 Claims, 7 Drawing Sheets

(56) References Cited

U.S. PATENT DOCUMENTS

| | | | | |
|---|---|---|---|---|
| 2002/0036057 | A1 | 3/2002 | Kistner et al. | |
| 2003/0209047 | A1* | 11/2003 | Nelepovitz | B21D 15/10 72/61 |
| 2007/0102494 | A1* | 5/2007 | Connelly | B21D 26/055 228/157 |
| 2015/0102128 | A1* | 4/2015 | Douglas | B21D 26/021 239/265.19 |

OTHER PUBLICATIONS

ASM International Handbook Committee. (1991). ASM Handbook, vol. 04—Heat Treating. ASM International. Retrieved from https://app.knovel.com/hotlink/toc/id:kpASMHVHT3/asm-handbook-volume-04/asm-handbook-volume-04 (Year: 1991).*

* cited by examiner

SANDWICH STRUCTURE AND ASSOCIATED PRESSURE-BASED FORMING METHOD

FIELD

This application relates to sandwich structures and, more particularly, to the forming of sandwich structures.

BACKGROUND

Honeycomb sandwich structures are typically formed from a honeycomb core sandwiched between two liner sheets. The honeycomb core may be relatively thick, yet lightweight, as compared to the liner sheets. The liner sheets may be relatively thin, yet stiff. Therefore, honeycomb sandwich structures typically possess relatively high strength and stiffness at relatively low weight. As such, honeycomb sandwich structures are widely used in various aerospace applications.

In their most basic form, honeycomb sandwich structures are constructed as generally flat (planar) panels. However, it is often desirable to integrate honeycomb sandwich structures into more complex, non-planar welded assemblies. Such integration requires forming honeycomb sandwich structures such that they assume the contours required by the particular application.

Surface contour control is critical for successful fit-up and welding of complex assemblies. However, precise surface contour control is difficult to obtain with honeycomb sandwich structures. For example, when a typical honeycomb sandwich structure is mechanically pressed against a contoured tool, the non-tool controlled surface often becomes distorted, which makes fit-up difficult (if not impractical).

Accordingly, those skilled in the art continue with research and development efforts in the field of honeycomb sandwich structures.

SUMMARY

In one embodiment, disclosed is a method for forming a sandwich structure that includes a core positioned between a first liner sheet and a second liner sheet. The method includes the steps of (1) positioning the sandwich structure into a cavity of a die assembly; and (2) pressurizing the core to expand the sandwich structure into engagement with the die assembly.

In another embodiment, the disclosed forming method may include the steps of (1) providing a sandwich structure comprising a core having a honeycomb structure positioned between a first liner sheet and a second liner sheet; (2) positioning the sandwich structure into a cavity of a die assembly; (3) heating the sandwich structure; and (4) pressurizing the core with a gas to expand the heated sandwich structure into engagement with the die assembly.

In yet another embodiment, the disclosed forming method may include the steps of (1) providing a sandwich structure comprising a core having a honeycomb structure positioned between a first liner sheet and a second liner sheet; (2) mechanically deforming the sandwich structure; (3) heat treating the mechanically deformed sandwich structure; (4) porting the sandwich structure to provide fluid communication with free air space defined by the core; (5) positioning the sandwich structure into a cavity of a die assembly; (6) heating the sandwich structure in the die assembly; and (7) pressurizing the core with a heated gas to expand the sandwich structure into engagement with the die assembly.

Other embodiments of the disclosed honeycomb sandwich structure and associated pressure-based forming method will become apparent from the following detailed description, the accompanying drawings and the appended claims.

DETAILED DESCRIPTION

Disclosed is a method for forming a sandwich structure, such as a honeycomb sandwich structure. The disclosed forming method advantageously enhances surface contour control, thereby facilitating the manufacture of complex, non-planar assemblies for various applications.

Figure 1:
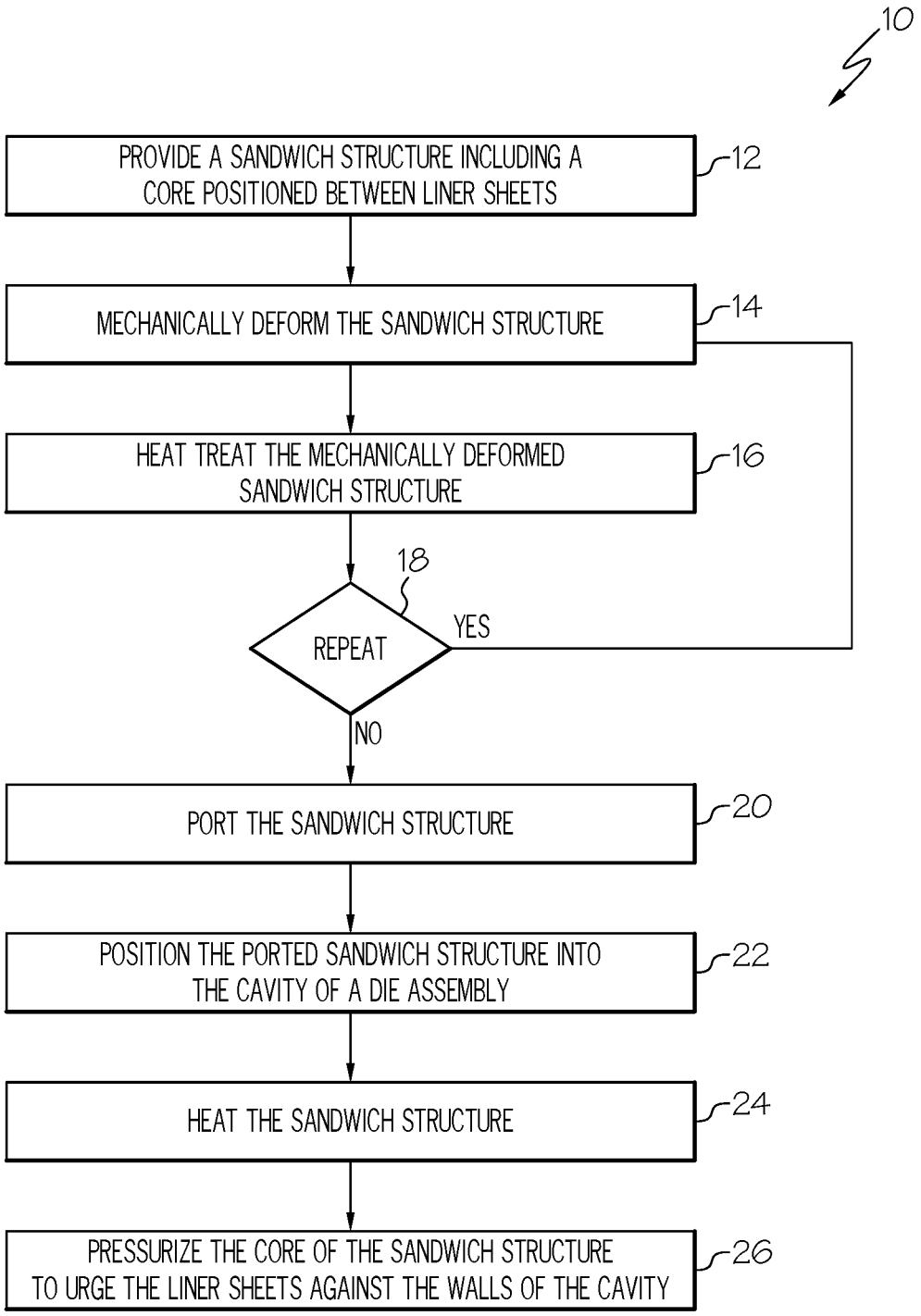
FIG. 1 is a flow diagram depicting one embodiment of the disclosed method for forming a honeycomb sandwich structure.
Figure 2A:
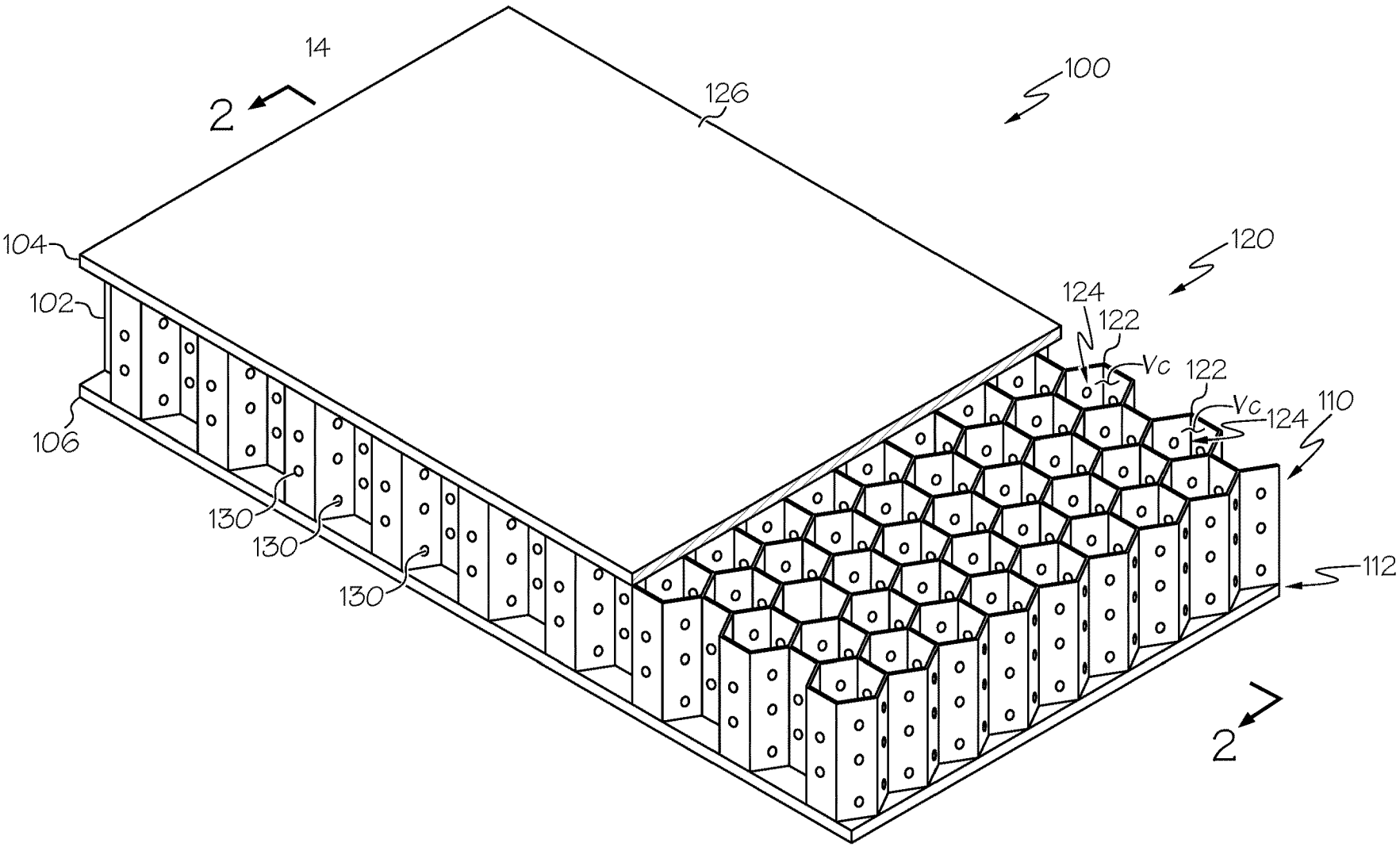
FIG. 2A is a perspective view of a honeycomb sandwich structure during one stage of the disclosed forming method.
Figure 2B:
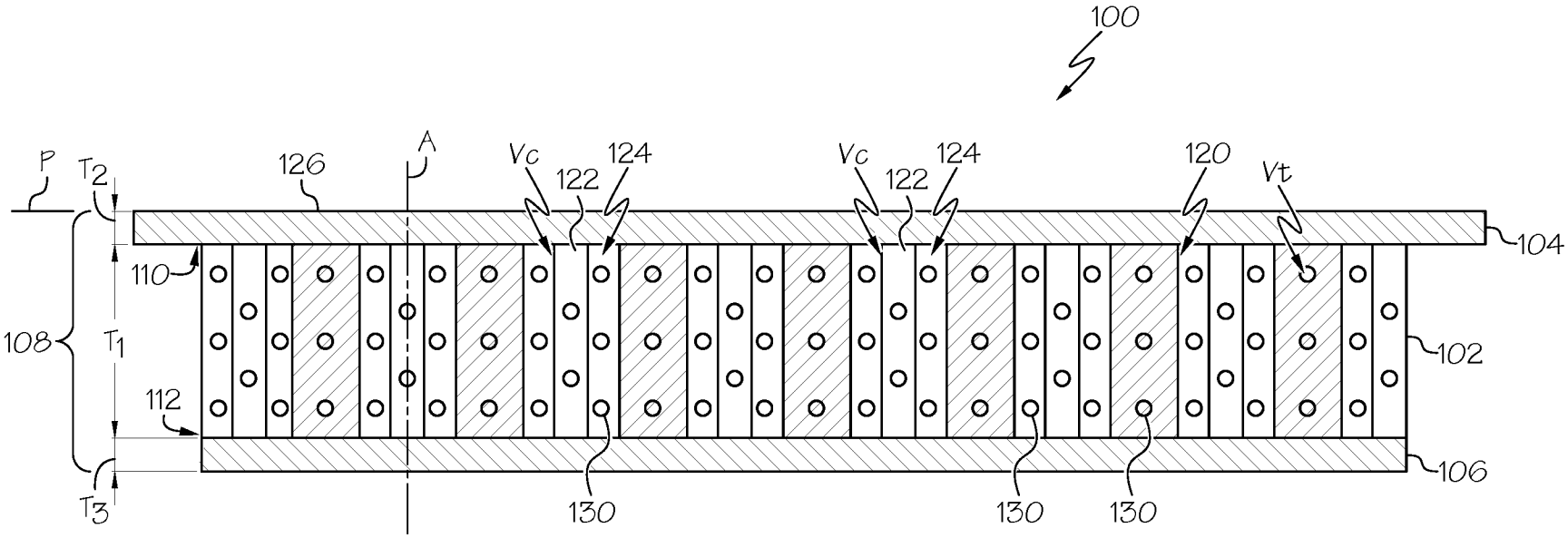
FIG. 2B is a side elevational view, in section, of the honeycomb sandwich structure of FIG. 2A.

Referring to FIG. 1, one embodiment of the disclosed forming method, generally designated 10, may begin at Block 12 with the step of providing a sandwich structure, such as the sandwich structure 100 shown in FIGS. 2A and 2B. As one example, a sandwich structure may be provided by assembling, whether on-site or off-site, a sandwich structure (e.g., welding liner sheets to a core). As another example, a sandwich structure may be provided by sourcing a sandwich structure from another (e.g., a supplier).

Referring to FIGS. 2A and 2B, in one particular implementation, the sandwich structure 100 may include a core 102, a first liner sheet 104 and a second liner sheet 106. The core 102, the first liner sheet 104 and the second liner sheet 106 may be connected together to form a layered structure 108 (FIG. 2B). While the layered structure 108 of the sandwich structure 100 is shown and described having three layers (the core 102, the first liner sheet 104 and the second liner sheet 106), additional layers, such as additional core layers, additional liner sheets and/or additional other layers, may be included in the layered structure 108 without departing from the scope of the present disclosure.

The core 102 of the sandwich structure 100 may include a first major side 110 and an opposed second major side 112. The first liner sheet 104 may be connected (e.g., adhered, welded, braised, mechanically fastened etc.) to the first major side 110 of the core 102 and the second liner sheet 106 may be connected (e.g., adhered, welded, braised, mechanically fastened etc.) to the second major side 112 of the core 102, thereby sandwiching the core 102 between the first liner sheet 104 and the second liner sheet 106, and forming the layered structure 108.

The cross-sectional thickness $T_1$ of the core 102 of the sandwich structure 100 may be relatively thick, as compared to the cross-sectional thicknesses $T_2$, $T_3$ of the first liner sheet 104 and the second liner sheet 106 (e.g., $T_1>T_2$ and $T_1>T_3$). In one expression, the cross-sectional thickness $T_1$ of the core 102 may be at least 1.5 times greater than the cross-sectional thickness $T_2$ of the first liner sheet 104. In another expression, the cross-sectional thickness $T_1$ of the core 102 may be at least 2 times greater than the cross-sectional thickness $T_2$ of the first liner sheet 104. In another expression, the cross-sectional thickness $T_1$ of the core 102 may be at least 5 times greater than the cross-sectional thickness $T_2$ of the first liner sheet 104. In another expression, the cross-sectional thickness $T_1$ of the core 102 may be at least 10 times greater than the cross-sectional thickness $T_2$ of the first liner sheet 104. In another expression, the cross-sectional thickness $T_1$ of the core 102 may be at least 20 times greater than the cross-sectional thickness $T_2$ of the first liner sheet 104. In yet another expression, the cross-sectional thickness $T_1$ of the core 102 may be at least 40 times greater than the cross-sectional thickness $T_2$ of the first liner sheet 104. Despite being relatively thick, the core 102 may have a relatively lower density (basis weight divided by cross-sectional thickness), as compared to the densities of the first liner sheet 104 and the second liner sheet 106.

The core 102 of the sandwich structure 100 may have a honeycomb structure 120, as best shown in FIG. 2A. The honeycomb structure 120 of the core 102 may include an array of tightly packed cells 122, with each cell 122 of the honeycomb structure 120 defining an associated cavity 124 having a cavity volume $V_c$. Therefore, the core 102 may have a total open volume $V_t$ (FIG. 2B), which may be based on the total number of cells 122 in the core 102 and the cavity volume $V_c$ of each cell 122.

The cells 122 of the honeycomb structure 120 of the core 102 may be tubular and may have a cross-sectional shape, such as hexagonal (see FIG. 2A), square, rectangular, circular, ovular, or the like. The cells 122 of the honeycomb structure 120 may extend along an axis A (FIG. 2B) that is generally perpendicular to a plane P (FIG. 2B) coincident with the outer surface 126 of the first liner sheet 104. Therefore, the cavities 124 defined by the cells 122 of the honeycomb structure 120 may extend continuously through the core 102 from the first liner sheet 104 to the second liner sheet 106, and may be bounded by the core 102 and the first and second liner sheets 104, 106.

While a core 102 having a honeycomb structure 120 with uniform and regular-shaped cells 122 is shown and described, those skilled in the art will appreciate that cavities 124 having various three-dimensional shapes, whether regular or irregular, may define the open volume $V_t$ of the core 102, and may be used without departing from the scope of the present disclosure. Therefore, a honeycomb structure 120 is only one specific, non-limiting example of a suitable structure for the core 102 of the sandwich structure 100.

Compositionally, the core 102 of the sandwich structure 100 may be formed from various materials or combinations of materials. Those skilled in the art will appreciate that material selection will depend on the intended application, among other possible considerations. As one general example, the core 102 may be formed from a metallic material, such as steel, titanium, a titanium alloy, aluminum or an aluminum alloy. One specific example of a suitable metallic material is A286 (an iron-based super alloy). Another specific example of a suitable metallic material is nickel alloy 625. As another general example, the core 102 may be formed from a composite, such as a carbon fiber-reinforced composite or a fiberglass composite.

The core 102 of the sandwich structure 100 may optionally be perforated. For example, as shown in FIGS. 2A and 2B, the core 102 may define a plurality of apertures 130. The apertures 130 of the core 102 may provide fluid communication between the cavities 124 of the core 102. Therefore, a pressure change in one cavity 124 of the core 102 may be experienced in all cavities 124 of the core 102. While an orderly arrangement of generally circular apertures 130 is shown in FIGS. 2A and 2B, various arrangements of apertures 130 and various shapes/configurations of the apertures 130 may be used to facilitate fluid communication between the cavities 124. Therefore, variations in the way the core 102 is perforated (or otherwise configured to achieve fluid communication between cavities 124) will not result in a departure from the scope of the present disclosure.

The first liner sheet 104 of the sandwich structure 100 may be layered over the first major side 110 of the core 102, thereby at least partially enclosing the cavities 124 of the core 102 along the first major side 110. Connection between the first liner sheet 104 and the core 102 may be effected using any suitable technique, the selection of which may require consideration of the composition of the core 102 and the composition of the first liner sheet 104. Examples of techniques that may be used to connect the first liner sheet 104 to the core 102 include, but are not limited to, welding, braising, soldering, bonding, adhering and/or mechanically fastening.

Compositionally, the first liner sheet 104 of the sandwich structure 100, which may be single ply or multi-ply, may be formed from various materials or combinations of materials. The composition of the first liner sheet 104 may be the same as, similar to, or different from the composition of the core 102. As one general example, the first liner sheet 104 may be formed from a metallic material, such as steel, titanium, a titanium alloy, aluminum or an aluminum alloy. One specific example of a suitable metallic material is A286 (an iron-based super alloy). Another specific example of a suitable metallic material is nickel alloy 625. As another general example, the first liner sheet 104 may be formed from a composite, such as a carbon fiber-reinforced composite or a fiberglass composite.

The second liner sheet 106 of the sandwich structure 100 may be layered over the second major side 112 of the core 102, thereby enclosing the cavities 124 of the core 102 along the second major side 112. Connection between the second liner sheet 106 and the core 102 may be effected using any suitable technique, the selection of which may require consideration of the composition of the core 102 and the composition of the second liner sheet 106. Examples of techniques that may be used to connect the second liner sheet 106 to the core 102 include, but are not limited to, welding, braising, soldering, bonding, adhering and/or mechanically fastening.

Compositionally, the second liner sheet 106 of the sandwich structure 100, which may be single ply or multi-ply, may be formed from various materials or combinations of materials. The composition of the second liner sheet 106 may be the same as, similar to, or different from the composition of the core 102. Also, the composition of the second liner sheet 106 may be the same as, similar to, or different from the composition of the first liner sheet 104. As one general example, the second liner sheet 106 may be formed from a metallic material, such as steel, titanium, a titanium alloy, aluminum or an aluminum alloy. One specific example of a suitable metallic material is A286 (an iron-based super alloy). Another specific example of a suitable metallic material is nickel alloy 625. As another general example, the second liner sheet 106 may be formed from a composite, such as a carbon fiber-reinforced composite or a fiberglass composite.

At this point, those skilled in the art will appreciate that only a portion of a sandwich structure 100 is shown in FIGS. 2A and 2B, and that the overall size and shape of the sandwich structure 100 may depend on the end application. Additionally, while the sandwich structure 100 is shown in FIGS. 2A and 2B as being a substantially planar structure, non-planar sandwich structures 100 (e.g., curved sandwich structures 100) may also be provided at Block 12 (FIG. 1).

Referring back to FIG. 1, the sandwich structure 100 (FIGS. 2A and 2B) may be mechanically deformed at Block 14 of the disclosed forming method 10. The mechanically deforming step (Block 14), while optional, may change the shape of the sandwich structure 100, thereby bringing the shape of the sandwich structure 100 closer to the intended shape of the sandwich structure 100.

Figure 3:
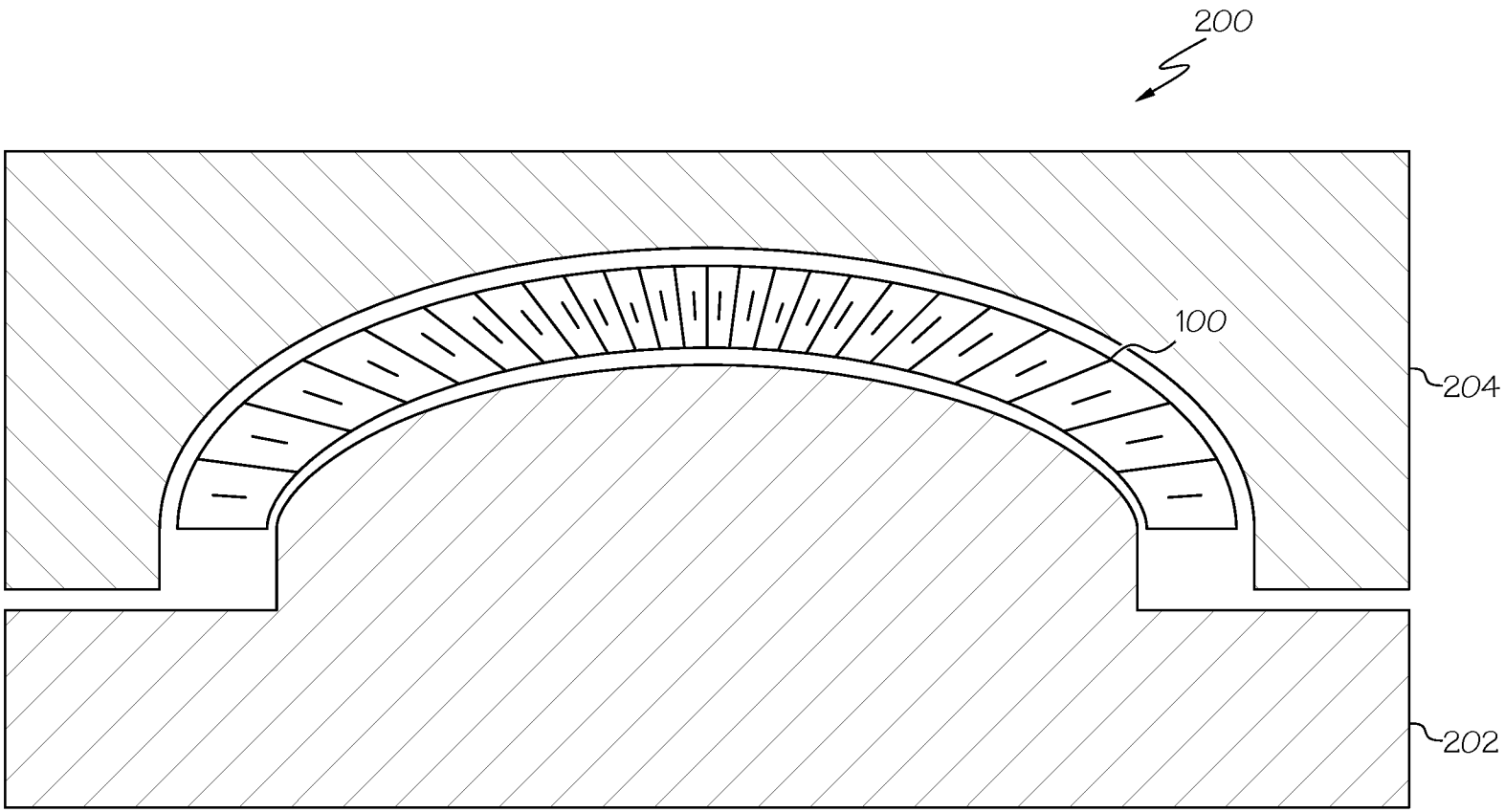
FIG. 3 is a side elevational view, in section, of a honeycomb sandwich structure during another (mechanical deforming) stage of the disclosed forming method.

Various techniques may be used to mechanically deform (Block 14) the sandwich structure 100 (FIGS. 2A and 2B). As one specific, non-limiting example, the sandwich structure 100 may be mechanically deformed (Block 14) using a die assembly 200, as shown in FIG. 3. The die assembly 200 may include a male die member 202 and a female die member 204. Therefore, the mechanically deforming step (Block 14) may include pressing the sandwich structure 100 between the male and female die members 202, 204 of the die assembly 200.

The mechanically deforming step (Block 14) may be performed while the sandwich structure 100 is "cold" (e.g., at ambient temperature). Alternatively, the sandwich structure 100 may be heated before/during the mechanically deforming step (Block 14), thereby hot forming the sandwich structure 100.

Thus, the sandwich structure 100 may initially be flat/planar, as shown in FIGS. 2A and 2B, and the mechanically deforming step (Block 14) may impart contour to the sandwich structure 100, as shown in FIG. 3. Alternatively, the sandwich structure 100 may initially be contoured, and the mechanically deforming step (Block 14) may impart further contour to the sandwich structure 100.

At Block 16, the mechanically deformed sandwich panel 100 may optionally be heat treated. As one specific, non-limiting example, the mechanically deformed sandwich panel 100 may be annealed at Block 16, particularly when the sandwich panel 100 was cold worked during the mechanically deforming step (Block 14). Annealing (at Block 16) may soften the sandwich panel 100, thereby rendering the sandwich panel 100 ready for additional mechanical work.

At Block 18, the forming method 10 may optionally query whether the mechanically deforming step (Block 14) should be repeated. Depending on the final intended shape of the sandwich structure 100, multiple mechanically deforming steps (Block 14) may be required. Therefore, the mechanically deforming step (Block 14) may be repeated (Block 18) such that each incremental mechanically deforming step (Block 14) brings the sandwich structure 100 closer to the intended shape. Each incremental mechanically deforming step (Block 14) may optionally be followed by a heat treatment step (Block 16).

Figure 4:
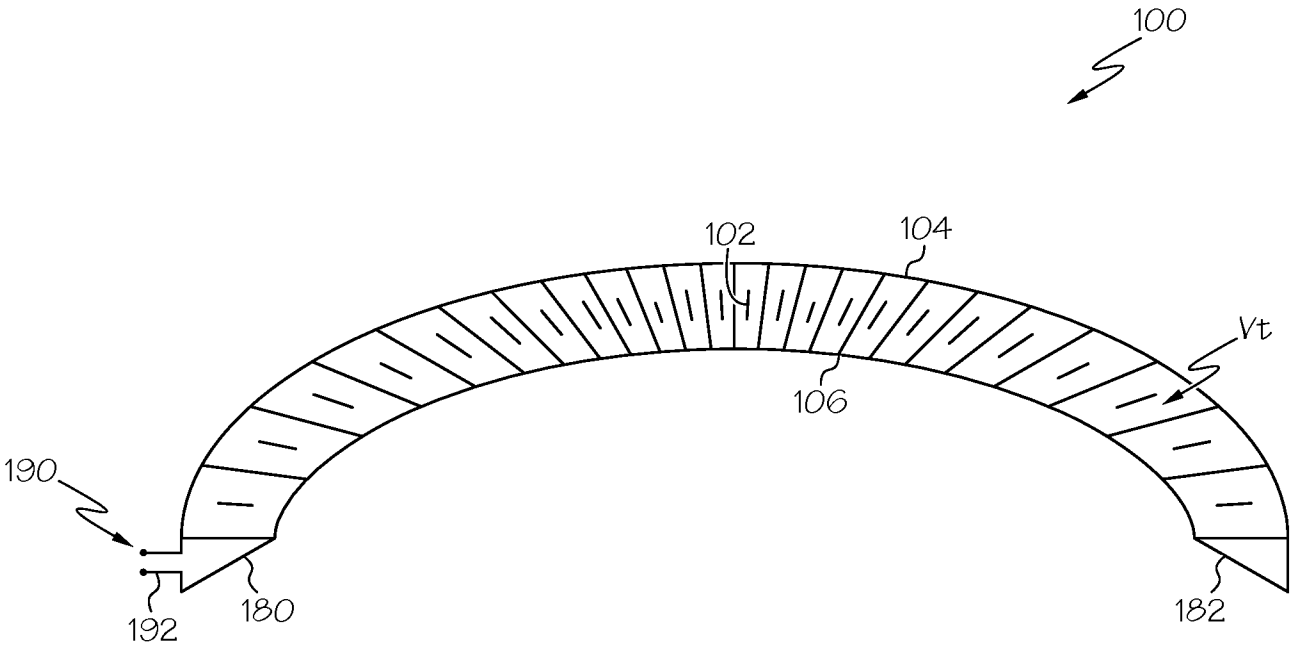
FIG. 4 is a side elevational view, in section, of a honeycomb sandwich structure during another (porting) stage of the disclosed forming method.

At Block 20, the sandwich structure 100 (FIG. 4) may be ported to facilitate fluid communication with the open volume Vt (FIG. 4) of the core 102 (FIG. 4). In one construction, shown in FIG. 4, the core 102 of the sandwich structure 100 may be sealed along the edges 180, 182, and a fluid port 190 may be formed to provide fluid communication with the sealed open volume $V_t$ of the core 102. The fluid port 190 may include an externally threaded nipple 192 or the like connected (e.g., welded) to one of the liner sheets 104, 106.

Figure 5:
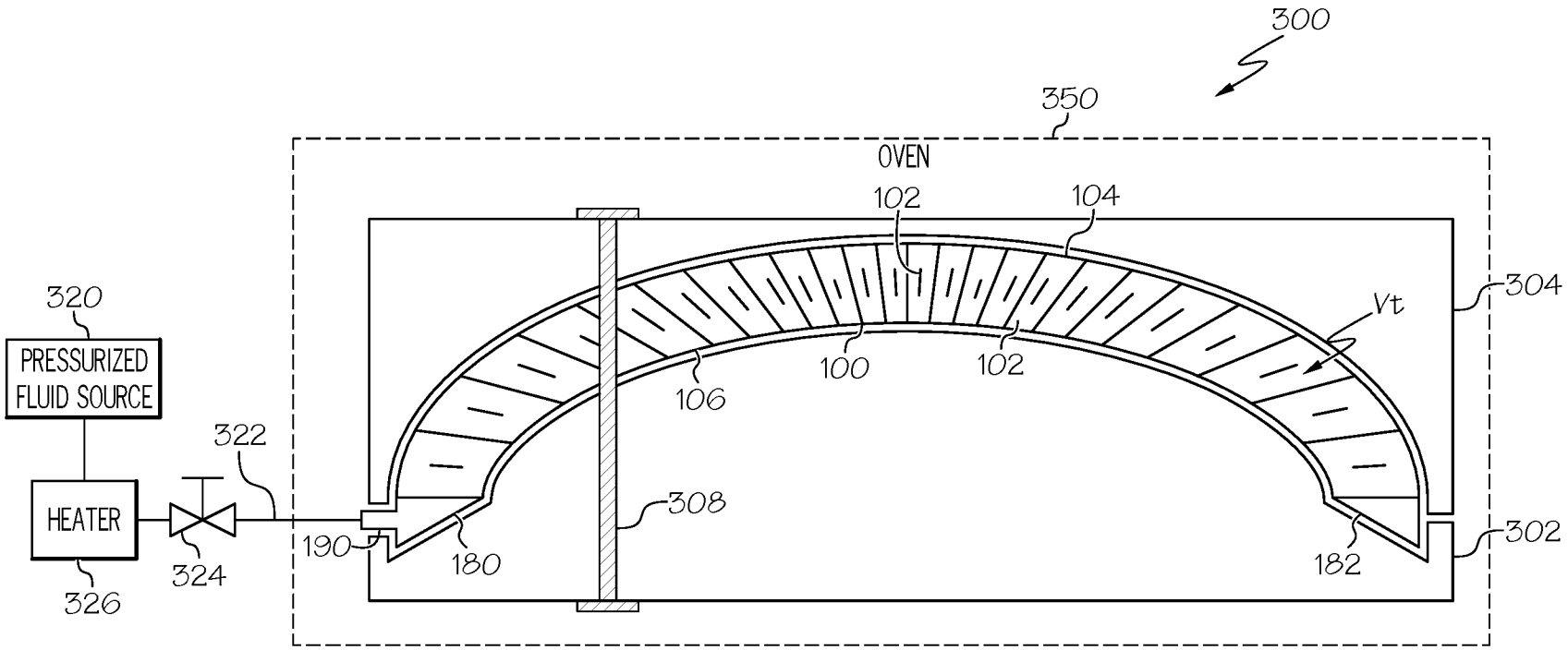
FIG. 5 is a side elevational view, in section, of a honeycomb sandwich structure during yet another (pressure forming) stage of the disclosed forming method.

At Block 22, the ported sandwich structure 100 may be positioned in a die assembly 300, as shown in FIG. 5. The die assembly 300 may include a first die member 302 and a second die member 304, and the first and second die members 302, 304 may be assembled to define a cavity 306. The cavity 306 may have a shape that corresponds to the intended shape of the sandwich structure 100. The sandwich structure 100 may be positioned in the cavity 306 of the die assembly 300 such that the fluid port 190 of the sandwich structure 100 is accessible externally of the die assembly 300. A clamp 308 may secure the first die member 302 in engagement with the second die member 304, thereby inhibiting unintentional displacement of the first die member 302 relative to the second die member 304.

At Block 24, the sandwich structure 100 (FIG. 5) may be heated. Various techniques, whether conduction, convention and/or radiation-based, may be used to heat the sandwich structure 100. As one specific non-limiting example, as shown in FIG. 5, the die assembly 300 (including the sandwich structure 100) may be positioned in an oven 350 maintained at an elevated temperature.

The heating step (Block 24) may heat the sandwich structure 100 (FIG. 5) to a temperature that is greater than ambient temperature. In one expression, the heating step (Block 24) may heat the sandwich structure 100 to a temperature of at least 100° C. In another expression, the heating step (Block 24) may heat the sandwich structure 100 to a temperature of at least 200° C. In another expression, the heating step (Block 24) may heat the sandwich structure 100 to a temperature of at least 300° C. In another expression, the heating step (Block 24) may heat the sandwich structure 100 to a temperature of at least 400° C. In another expression, the heating step (Block 24) may heat the sandwich structure 100 to a temperature of at least 500° C. In another expression, the sandwich structure 100 may be formed from a metallic material having a recrystallization temperature, and the heating step (Block 24) may heat the sandwich structure 100 to a temperature that is equal to or greater than the recrystallization temperature. In yet another expression, the sandwich structure 100 may be formed from a metallic material, and the heating step (Block 24) may heat the sandwich structure 100 to a temperature sufficient to render the metallic material superplastic.

At Block 26, the open volume $V_t$ (FIG. 5) of the core 102 (FIG. 5) of the sandwich structure 100 (FIG. 5) may be pressurized. Upon pressurization, the core 102 of the sandwich structure 100 may expand, which may urge the liner sheets 104, 106 against the first and second die members 302, 304 of the die assembly 300, thereby imparting to the sandwich structure 100 the shape of the cavity 306.

Referring to FIG. 5, pressurization (Block 26 in FIG. 1) of the core 102 of the sandwich structure 100 may be effected by introducing a fluid from a pressurized fluid source 320 (e.g., a compressor, a pump, a pressure vessel or the like) to the core 102 of the sandwich structure 100 by way of a fluid line 322 coupled with the fluid port 190. A valve 324 may be provided to control the flow of fluid from the pressurized fluid source 320 to the core 102 of the sandwich structure 100.

Various fluids may be used for pressurization (Block 26 in FIG. 1). The fluid supplied by the pressurized fluid source 320 may be a gas. As one specific, non-limiting example, the fluid supplied by the pressurized fluid source 320 may be air. As another specific, non-limiting example, the fluid supplied by the pressurized fluid source 320 may be an inert gas or an inert gaseous mixture. The use of a liquid fluid (e.g., hydraulic fluid) is also contemplated.

The fluid from the pressurized fluid source 320 may optionally be heated prior to being introduced to the core 102 of the sandwich structure 100. For example, a heater 326 (e.g., a heat exchanger, a burner or the like) may be disposed on the fluid line 322, and may heat the fluid prior to the fluid being introduced to the core 102.

The heater 326 may heat the fluid to a temperature that is greater than ambient temperature. In one expression, the heater 326 may heat the fluid to a temperature of at least 100° C. In another expression, the heater 326 may heat the fluid to a temperature of at least 200° C. In another expression, the heater 326 may heat the fluid to a temperature of at least 300° C. In another expression, the heater 326 may heat the fluid to a temperature of at least 400° C. In another expression, the heater 326 may heat the fluid to a temperature of at least 500° C. In another expression, the sandwich structure 100 may be formed from a metallic material having a recrystallization temperature, and the heater 326 may heat the fluid to a temperature that is equal to or greater than the recrystallization temperature. In yet another expression, the sandwich structure 100 may be formed from a metallic material, and the heater 326 may heat the fluid to a temperature sufficient to render the metallic material superplastic.

At this point, those skilled in the art will appreciate that heating the fluid from the pressurized fluid source 320 may be in addition to heating the sandwich structure 100/die assembly 300 (e.g., with oven 350), or may be done as an alternative to heating the sandwich structure 100/die assembly 300 (e.g., with oven 350). Therefore, while the heating step (Block 24) is shown in FIG. 1 occurring prior to the pressurizing step (Block 26), both the heating step (Block 24) and the pressurizing step (Block 26) may be performed simultaneously.

Accordingly, the disclosed forming method 10 may employ a mechanical deforming step (Block 14) to roughly approximate the intended shape of the sandwich structure 100. Then, the disclosed forming method 10 may employ fluid pressure (and optionally heat) to expand the sandwich structure 100 within the cavity 306 of a die assembly 300, thereby yielding an expanded sandwich structure 100 having the intended shape assumed from the cavity 306.

Figure 6:
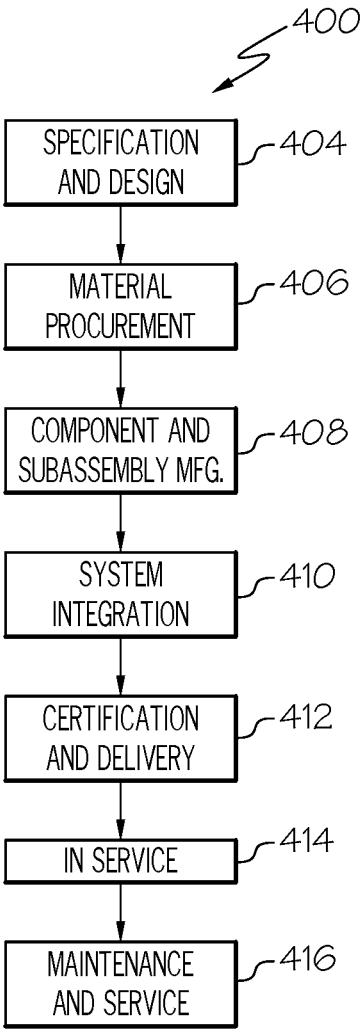
FIG. 6 is a flow diagram of an aircraft manufacturing and service methodology.
Figure 7:
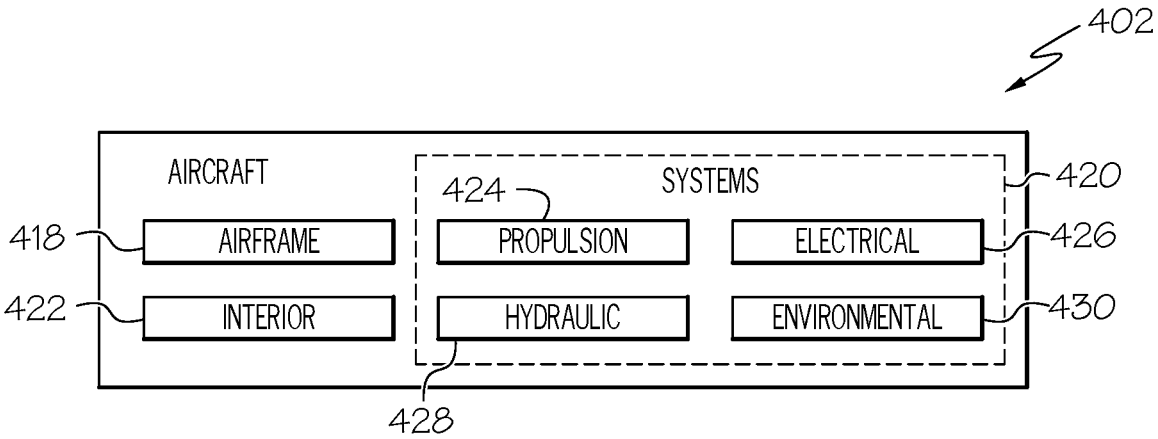
FIG. 7 is a block diagram of an aircraft.

Examples of the disclosure may be described in the context of an aircraft manufacturing and service method 400, as shown in FIG. 6, and an aircraft 402, as shown in FIG. 7. During pre-production, the aircraft manufacturing and service method 400 may include specification and design 404 of the aircraft 402 and material procurement 406. During production, component/subassembly manufacturing 408 and system integration 410 of the aircraft 402 takes place. Thereafter, the aircraft 402 may go through certification and delivery 412 in order to be placed in service 414. While in service by a customer, the aircraft 402 is scheduled for routine maintenance and service 416, which may also include modification, reconfiguration, refurbishment and the like.

Each of the processes of method 400 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 7, the aircraft 402 produced by example method 400 may include an airframe 418 with a plurality of systems 420 and an interior 422. Examples of the plurality of systems 420 may include one or more of a propulsion system 424, an electrical system 426, a hydraulic system 428, and an environmental system 430. Any number of other systems may be included.

The disclosed sandwich structure and associated pressure-based forming method may be employed during any one or more of the stages of the aircraft manufacturing and service method 400. As one example, the disclosed sandwich structure and associated pressure-based forming method may be employed during material procurement 406. As another example, components or subassemblies corresponding to component/subassembly manufacturing 408, system integration 410, and or maintenance and service 416 may be fabricated or manufactured using the disclosed sandwich structure and associated pressure-based forming method. As another example, the airframe 418 and the interior 422 may be constructed using the disclosed sandwich structure and associated pressure-based forming method. Also, one or more apparatus examples, method examples, or a combination thereof may be utilized during component/subassembly manufacturing 408 and/or system integration 410, for example, by substantially expediting assembly of or reducing the cost of an aircraft 402, such as the airframe 418 and/or the interior 422. Similarly, one or more of system examples, method examples, or a combination thereof may be utilized while the aircraft 402 is in service, for example and without limitation, to maintenance and service 416.

The disclosed sandwich structure and associated pressure-based forming method are described in the context of an aircraft; however, one of ordinary skill in the art will readily recognize that the disclosed sandwich structure and associated pressure-based forming method may be utilized for a variety of applications. For example, the disclosed sandwich structure and associated pressure-based forming method may be implemented in various types of vehicles including, e.g., helicopters, passenger ships, automobiles and the like.

Although various embodiments of the disclosed sandwich structure and associated pressure-based forming method have been shown and described, modifications may occur to those skilled in the art upon reading the specification. The present application includes such modifications and is limited only by the scope of the claims.

What is claimed is:

1. A method for pressure-based forming comprising: providing a sandwich structure comprising a core comprising a first side and a second side, a first liner sheet directly connected to said first side of said core, and a second liner sheet directly connected to said second side of said core, wherein said core further comprises a honeycomb structure comprising a plurality of cells and a plurality of apertures formed through said plurality of cells such that said plurality of cells are in fluid communication;

sealing peripheral edges of said first liner sheet and said second liner sheet to form a sealed internal volume defined by said core, said first liner sheet, and said second liner sheet;

forming a fluid port though one of said first liner sheet or said second liner sheet such that said sealed volume formed by said core, said first liner sheet, and said second liner sheet is in fluid communication with said fluid port;

positioning said sandwich structure into a cavity of a die assembly formed by a first die member and an opposing second die member; and after said positioning, pressurizing said sealed volume formed by said core, said first liner sheet, and said second liner sheet via said fluid port;

during said pressurizing, pushing both said first liner sheet and said second liner sheet away from each other and into direct physical engagement with said first die member and said second die member, respectively, of said die assembly;

during said pressurizing, expanding said core toward said first die member and said second die member in response to said pushing of said first liner sheet and said second liner sheet away from each other; and forming an expanded sandwich structure comprising an expanded core having said honeycomb structure.

2. The method of claim 1 wherein at least one of said core, said first liner sheet and said second liner is formed from a metallic material.

3. The method of claim 1 wherein said cavity has a shape, and wherein said shape is the same as an intended shape of said expanded sandwich structure.

4. The method of claim 1 wherein said pressurizing step comprises introducing a fluid into said core.

5. The method of claim 4 wherein said fluid is a gas.

6. The method of claim 4 wherein, prior to said introducing, said fluid is heated to a temperature of at least 100° C.

7. The method of claim 4 wherein, prior to said introducing, said fluid is heated to a temperature of at least 400° C.

8. The method of claim 1 further comprising heating said sandwich structure to a temperature of at least 100° C.

9. The method of claim 8 wherein said sandwich structure is heated prior to said pressurizing step or during said pressurizing step.

10. The method of claim 8 wherein said temperature is at least 400° C.

11. The method of claim 8 wherein said sandwich structure is formed from a metallic material having a recrystallization temperature, and wherein said temperature is at least said recrystallization temperature.

12. The method of claim 1 wherein said die assembly is positioned in an oven.

13. The method of claim 1 further comprising mechanically deforming said sandwich structure prior to positioning said sandwich structure into said cavity.

14. The method of claim 13 further comprising annealing said sandwich structure after said mechanically deforming step.

15. The method of claim 1 wherein each cell of said plurality of cells is tubular and extends continuously through said core from said first liner sheet to said second liner sheet.

16. The method of claim 15 wherein each cell of said plurality of cells extends along an axis that is generally perpendicular to a plane coincident with an outer surface of said first liner sheet.

17. The method of claim 15 wherein each cell of said plurality of cells has a hexagonal cross-sectional shape.

18. The method of claim 1 wherein each cell of said plurality of cells is directly connected to both said first liner sheet and said second liner sheet.

19. The method of claim 1 wherein said core, said first liner sheet, and said second liner sheet are formed from the same material.

20. The method of claim 1 wherein:

said first liner sheet and said second liner sheet are formed from a first material;

said core is formed from a second material; and said first material and said second material are different.

* * * * *